US007080649B2

(12) United States Patent
Hcu

(10) Patent No.: US 7,080,649 B2
(45) Date of Patent: Jul. 25, 2006

(54) CIGARETTE HOLDER

(76) Inventor: Hui-Ju Hcu, 58, Ma Yuan West St., Taichung (TW)

( * ) Notice: Subject to any disclaimer, the term of this patent is extended or adjusted under 35 U.S.C. 154(b) by 408 days.

(21) Appl. No.: 10/436,396

(22) Filed: May 8, 2003

(65) Prior Publication Data

US 2005/0051182 A1 Mar. 10, 2005

(51) Int. Cl.
*A24F 13/02* (2006.01)
*A24D 1/04* (2006.01)

(52) U.S. Cl. ..... 131/187; 131/200; 131/201; 131/203; 131/216; 131/331; 131/339

(58) Field of Classification Search ..... 131/200–203, 131/175, 187, 216, 191, 339, 331
See application file for complete search history.

(56) References Cited

U.S. PATENT DOCUMENTS 4,158,364 A * 6/1979 Ligeti ..... 131/187
4,267,849 A * 5/1981 Smith ..... 131/184.1
4,481,955 A * 11/1984 Terasaki ..... 131/216
4,517,989 A * 5/1985 Mensik ..... 131/187

* cited by examiner

*Primary Examiner*—Dionne W. Mayes
(74) *Attorney, Agent, or Firm*—Alan D. Kamrath; Nikolai & Mersereau, P.A.

(57) ABSTRACT

A cigarett holder has a mouthpiece, a cotton filter, a main pipe, and a filter column. The mouthpiece has a distal periphery flange, a head portion, an inner tube having a through hole, and an enlarged hole communicating with the through hole. The main pipe has a first chamber, a second chamber, an inner click portion, an inner tank, a center hole, and an insertion end inserted in the enlarged hole of the mouthpiece. The cotton filter is inserted in the second chamber of the main pipe. The filter column has an end flange, a recess hole, a vent hole communicating with the recess hole, an annular flange, and a distal pillar. The filter column is inserted in a middle portion of the main pipe.

2 Claims, 3 Drawing Sheets

CIGARETTE HOLDER

BACKGROUND OF THE INVENTION

The present invention relates to a cigarette holder. More particularly, the present invention relates to a cigarette holder which will filter toxic substance of a cigarette effectively.

Referring to FIGS. 4 and 5, a conventional cigarette holder has a mouthpiece 9, a cotton filter 8, and a main pipe 7. The mouthpiece 9 has a distal periphery flange 90, a through hole 92, and an enlarged hole 91 communicating with the through hole 92. The main pipe 7 has a first chamber 71, a second chamber 73, a disk 70 separating the first chamber 71 and the second chamber 73, and the disk 70 having a plurality of vent holes 72. The cotton filter 8 is inserted in the second chamber 73 of the main pipe 7. The enlarged hole 91 of the mouthpiece 9 receives a portion of the main pipe 7. The first chamber 71 of the main pipe 7 receives a cigarette 5. The cotton filter 8 will filter toxic substance of the cigarette 5. However, the cotton filter 8 cannot filter toxic substance of the cigarette 5 effectively.

SUMMARY OF THE INVENTION

An object of the present invention is to provide a cigarette holder which will filter toxic substance of a cigarette effectively.

Accordingly, a cigarette holder comprises a mouth-piece, a cotton filter, a main pipe, and a filter column. The mouthpiece has a distal periphery flange, a head portion, an inner tube having a through hole, and an enlarged hole communicating with the through hole. The main pipe has a first chamber, a second chamber, an inner click portion, an inner tank, a center hole, and an insertion end inserted in the enlarged hole of the mouthpiece. The cotton filter is inserted in the second chamber of the main pipe. The inner tube blocks the cotton filter. The filter column is inserted in a middle portion of the main pipe.

DETAILED DESCRIPTION OF THE INVENTION

Figure 1:
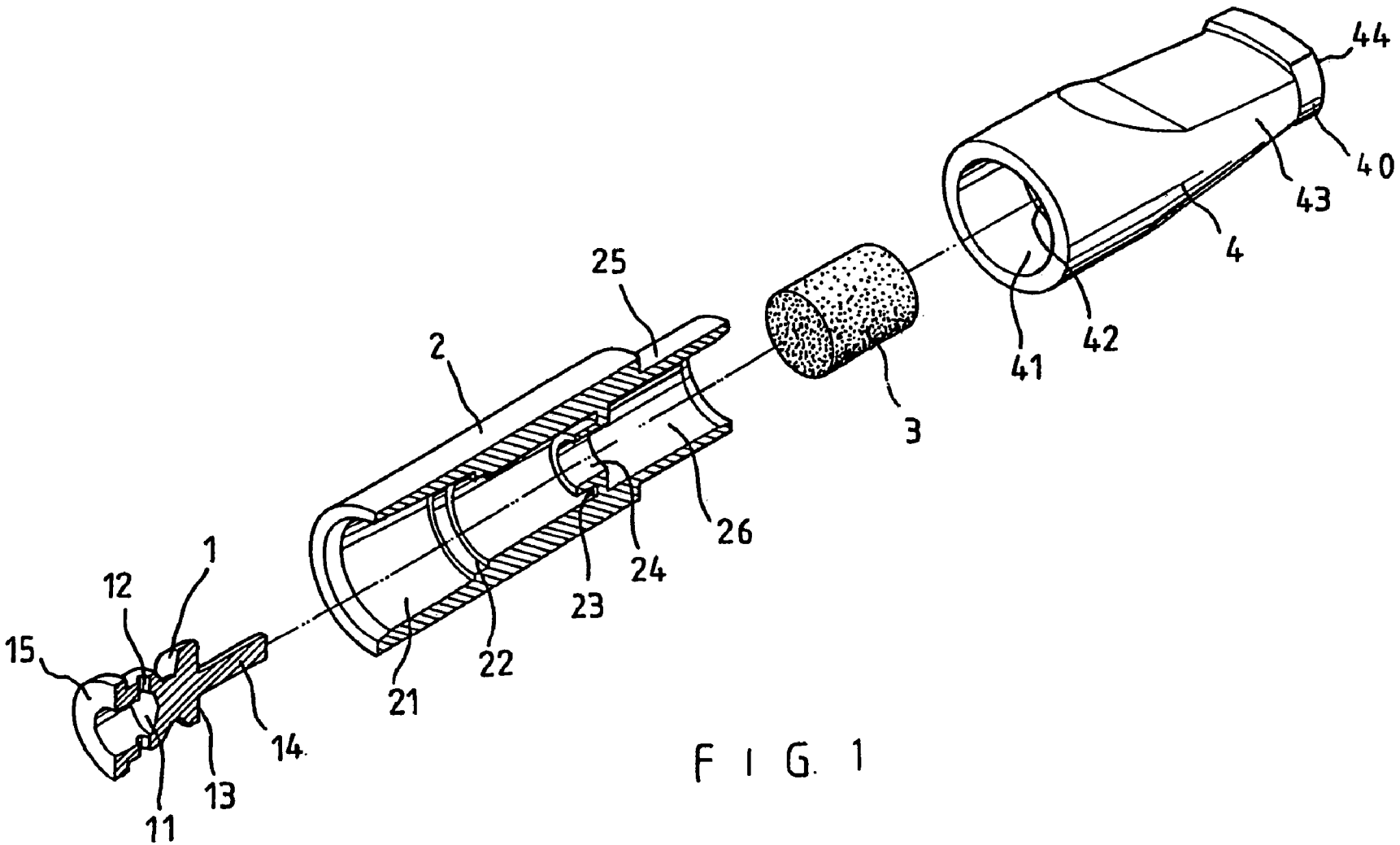
FIG. 1 is a perspective exploded view of a cigarette holder of a preferred embodiment in accordance with the present invention.
Figure 2:
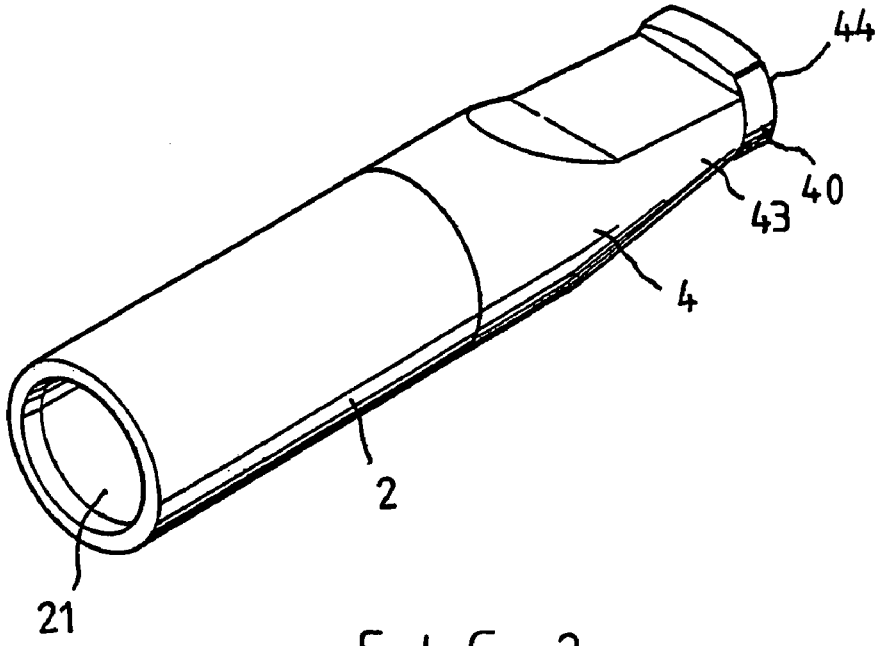
FIG. 2 is a perspective view of a cigarette holder of a preferred embodiment in accordance with the present invention.
Figure 3:
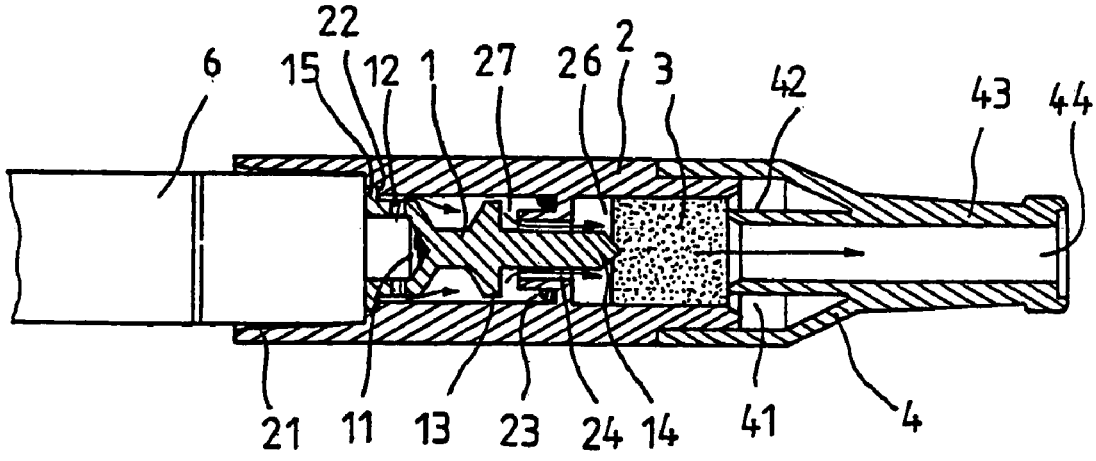
FIG. 3 is a sectional schematic view illustrating a cigarette inserted into a cigarette holder of a preferred embodiment in accordance with the present invention.
Figure 4:
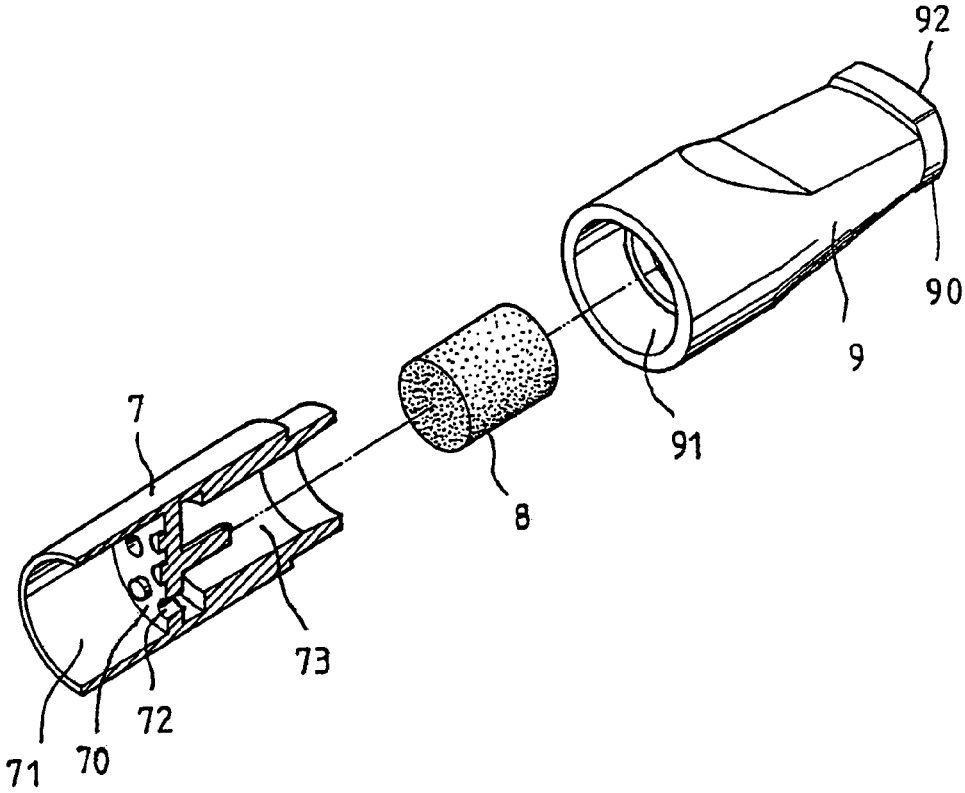
F I G. 4 PRIOR ART
FIG. 4 is a perspective exploded view of a conventional cigarette holder of the prior art.
Figure 5:
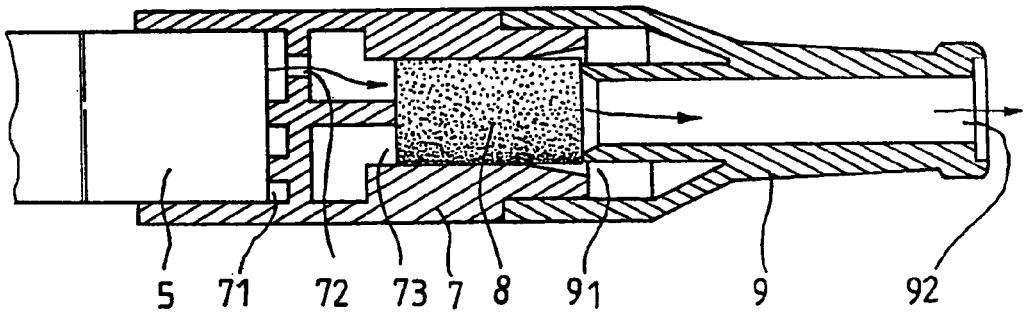
F I G. 5 PRIOR ART
FIG. 5 is a sectional schematic view illustrating a cigarette inserted into a conventional cigarette holder of the prior art.

Referring to FIGS. 1 to 3, a cigarette holder comprises a mouthpiece 4, a cotton filter 3, a main pipe 2, and a filter column 1.

The mouthpiece 4 has a distal periphery flange 40, a head portion 43, an inner tube 42 having a through hole 44, and an enlarged hole 41 communicating with the through hole 44.

The main pipe 2 has a first chamber 21, a second chamber 26, an inner click portion 22, an inner tank 23, a center hole 24, and an insertion end 25 inserted in the enlarged hole 41 of the mouthpiece 4.

The cotton filter 3 is inserted in the second chamber 26 of the main pipe 2.

The inner tube 42 blocks the cotton filter 3.

The filter column 1 has an end flange 15, a recess hole 11, a vent hole 12 communicating with the recess hole-11, an annular flange 13, and a distal pillar 14.

The filter column 1 is inserted in a middle portion of the main pipe 2.

The distal pillar 14 passes through the center hole 24 of the main pipe 2.

The end flange 15 of the filter column 1 is inserted in the inner click portion 22 of the main pipe 2.

A spacing 27 is formed between the main pipe 2 and the annular flange 13 of the filter column 1.

The first chamber 21 of the main pipe 2 receives a cigarette 6.

When smoke enters the cigarette holder, some toxic substance of the smoke precipitates in the recess hole 11 of the filter column 1. Heavy toxic substance of the smoke will precipitate in the inner tank 23. Light toxic substance of the smoke will be filtered by the cotton filter 3. Therefore, the cigarette holder will filter toxic substance of the smoke effectively.

The present invention is not limited to the above embodiment but various modification thereof may be made. Furthermore, various changes in form and detail may be made without departing from the scope of the present invention.

I claim:

1. A cigarette holder comprises:

a mouthpiece, a cotton filter, a main pipe, and a filter column, the mouthpiece having a distal periphery flange, a head portion, an inner tube having a through hole, and an enlarged hole communicating with the through hole, the main pipe having a first chamber, a second chamber, an inner click portion, an inner tank, a center hole, and an insertion end inserted in the enlarged hole of the mouthpiece, the cotton filter inserted in the second chamber of the main pipe, the inner tube blocking the cotton filter, and the filter column inserted in a middle portion of the main pipe, wherein the filter column has an end flange, a recess hole, a vent hole communicating with the recess hole, an annular flange, and a distal pillar.

2. The cigarette holder as claimed in claim 1, wherein the distal pillar passes through the center hole of the main pipe, the end flange of the filter column is inserted in the inner click portion of the main pipe, and a spacing is formed between the main pipe and the annular flange of the filter column.

* * * * *